United States Patent [19]

Stanton

[11] 4,161,048

[45] Jul. 17, 1979

[54] METHOD AND APPARATUS FOR STIFFENING SHOE INSOLES

[75] Inventor: Leo F. Stanton, Newburyport, Mass.

[73] Assignee: Bush Universal, Inc., Woburn, Mass.

[21] Appl. No.: 838,670

[22] Filed: Oct. 3, 1977

[51] Int. Cl.[2] ..... A43D 21/00; A43D 31/00; A43D 3/00

[52] U.S. Cl. ..... 12/146 S; 12/18.3; 12/126

[58] Field of Search ..... 12/1 R, 1 A, 18.3, 18.1, 12/146 S, 123, 126, 127

[56] References Cited

U.S. PATENT DOCUMENTS

| | | | |
|---|---|---|---|
| 2,472,524 | 6/1949 | Donovan | 12/18.3 |
| 2,669,734 | 2/1954 | Stacey | 12/18.3 |
| 4,000,535 | 1/1977 | Barton | 12/126 |

*Primary Examiner*—Patrick D. Lawson
*Attorney, Agent, or Firm*—Wolf, Greenfield & Sacks

[57] ABSTRACT

A method and apparatus for forming a shoe shank directly on the bottom of a shoe insole from a strip of initially flexible, uncured thermosetting material encased in a sleeve. The machine includes a shoe jack for supporting the shoe assembly, bottom up, to expose the insole bottom to a radiant heater. Means are provided for automatically locating and placing a strip of shank material on the insole bottom and for raising the shoe assembly, together with the insole strip into engagement with a means for urging the shank strip against and into conformity with the contour of the insole bottom while the radiant heater is operated to activate the shank strip.

25 Claims, 17 Drawing Figures

METHOD AND APPARATUS FOR STIFFENING SHOE INSOLES

BACKGROUND OF THE INVENTION

This invention relates to a method and apparatus for forming a shoe shank on the bottom of a shoe insole to stiffen the shank region which extends from the heel breast to the ball region. More particularly, the present invention is directed to a method and apparatus for applying, locating, retaining and curing a flexible strip of activatable thermosetting resinous material, directly in situ on the shoe bottom so that the strip may conform to the contour of the shoe bottom and adhere thereto in its stiffened, hardened form. Such strips are described in pending U.S. Patent Application Ser. No. 681,582, filed Apr. 29, 1976, now U.S. Pat. No. 4,081,917, issued Apr. 4, 1978; and in U.S. Patent Application Ser. No. 765,096, filed Feb. 3, 1977, both of said applications being assigned to the assignee of this application.

The present invention relates to further improvements to the method and apparatus described in my prior U.S. Patent Application Ser. No. 765,095, filed Feb. 3, 1977, now U.S. Pat. No. 4,122,573, issued Oct. 31, 1978.

Use of flexible, in situ-activatable strips to form a shank stiffener solves numerous problems which have been presented in the prior art of shoe manufacture. As described in Application Ser. No. 681,582, shank stiffeners typically have been inserted in shoes in the form of a stiff wood or steel pre-formed member. Because of a wide variety of styles and sizes of shoes, the typical prior art practice has required the manufacturer to maintain an inventory of a wide variety of different sizes and shapes of shanks. Numerous difficulties have been presented in the storage, proper selection and insertion of such shanks. The present invention relates to a method and apparatus by which an initially flexible and deformable shank strip may be formed directly in place on the shoe bottom to conform precisely to the shape of the insole bottom and be hardened in situ thereon by an external stimulus such as radiant energy.

SUMMARY OF THE INVENTION

The apparatus of the present invention includes a radiant energy source, such as an infrared heater, which is mounted to the frame of the machine. The energy source is constructed to direct radiant energy, in a band pattern, along the bottom of the shoe insole when the shoe assembly is positioned in the machine. In general, the machine includes an arrangement for supporting the shoe assembly, strip retaining means to engage and urge the shank strip against the insole bottom of the shoe assembly, means for mounting the shoe support and strip retaining means for relative movement toward and away from each other, means for positioning a shank strip in alignment with and in between the strip retaining means and a supported shoe assembly, to enable an aligned shoe assembly, shank strip and the strip retaining means to be combined, and in further combination with a means for activating the strip.

More specifically, a shoe jack assembly is provided to firmly clamp and support the shoe assembly beneath the radiant heater and in a bottom-up position in which the insole faces the source of radiant energy. The shoe jack assembly is movable vertically toward and away from the radiant heater to enable the shoe assembly to be loaded in the jack when the jack is in its lowered position and then raised toward the heater to an activating position. A shank strip positioning means is provided in the form of a transfer mechanism to automatically locate and place the shank strip in a suspended, predetermined aligned position with respect to the insole bottom while the shoe assembly is in its lowered position.

A strip retaining means also is provided and has strip engaging portions which engage lateral marginal portions of the shank strip to press the marginal portions toward and against the shoe bottom and cause the flexible shank strip to conform approximately to the contour of the shoe bottom without interfering with the propagation of radiant energy to the middle portion of the shank strip which contains the activatable resin. The strip (margin) engaging means is disposed above the level of the insole of the shoe bottom when the jack is in its lowered position. As the jack and shoe assembly are raised toward the heater, the insole engages and carries the shank strip and strip transfer mechanism toward the strip retaining means. The marginal portions of the shank strip are brought into engagement with the margin engaging portions of the strip retaining means. The jack continues to rise in a short additional distance to cause the margin engaging means to press the marginal portion toward the shoe bottom. The margin engaging means is constructed so that it may impart a light lateral tensioning to the shank strip in response to the continued rise of the shoe assembly. As described in Application Ser. No. 765,095, that imparts a light lateral tension to the sleeve of the shank strip and tends to confine and limit the volume, shape and height of the finally cured shank strip beyond predetermined limits. Means are provided for withdrawing the strip transfer mechanism to a remote position, after the shoe assembly has been raised to its most heightwise position. The radiant heater is operated for a selected time interval after the shank strip transfer mechanism has been withdrawn. While in its remote position, the shank strip transfer mechanism is ready to receive a new shank strip in readiness for the subsequent cycle of operation.

It is among the general objects of the invention to provide an improved apparatus and method for applying to a shoe insole, an initially flexible and deformable shank strip formed from a curable resin material.

Another object of the invention is to provide a method and apparatus of the type described which assures that the shank will conform to the contour of the shoe bottom and will remain attached thereto.

A further object of the invention is to provide a method and apparatus of the type described in which the shank strip is urged into conformity with the contour of the shoe bottom and further in which the covering sleeve of the shank strip may be lightly and laterally tensioned during activation of the resin.

Another object of the invention is to provide an improved method and apparatus of the type described which provides control over the cross-sectional dimensions of the shank.

A further object of the invention is to provide an apparatus of the type described having an improved shoe jack means capable of being used both with low cut shoes as well as boots.

A further object of the invention is to provide an apparatus of the type described having means for automatically locating and positioning a shank strip in a predetermined location on the insole bottom.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
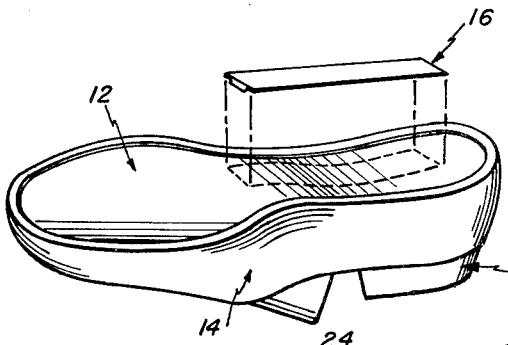
FIG. 1 shows a shoe assembly bottom-up, illustrating the manner in which the shank strip is to be located on the shoe bottom.
Figure 2:
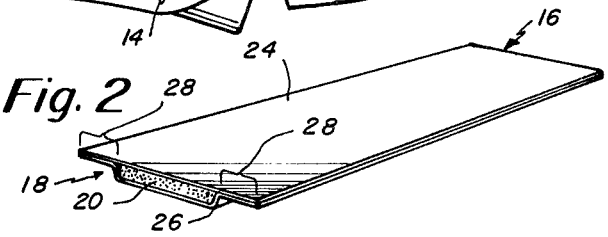
FIG. 2 is an illustration of a shank strip as used in accordance with the present invention.

The invention is concerned with improvements in the location and curing of an elongate strip of material in situ on the bottom of a partially formed shoe assembly. As shown in FIG. 1, the shoe assembly includes a last 10 having an insole 12 on its bottom and an upper 14 mounted on the last 10. The marginal portions of the upper 14 will already have been lasted to corresponding marginal portions of the insole 12. The shank strip 16, illustrated in FIG. 2, comprises an elongate sleeve 18 of flexible material which contains a matrix of a thermosetting resin 20 and a plurality of fiberglass strands embedded in the resin. The resin 20 is activatable by a selected external stimulus such as heat. The sleeve 18 preferably is formed from a pair of strips, including an upper strip 24 and a lower strip 26, which are sealed to each other along their longitudinal sides to define a pair of longitudinally extending margins 28. The sleeve is formed from a material which can transmit the external activating stimulus to the resinous matrix. For example, in the embodiment described, the activating stimulus is heat in the form of infrared energy and the sleeve is formed from a substantially transparent plastic material which will transmit infrared radiation therethrough to the matrix.

The shank strip 16 typically will be cut from a long supply "rope" thereof and is described in detail in the aforementioned copending U.S. patent applications. In general, the shank strip is flexible and is cut to a length so that it may be placed on the insole bottom as suggested in FIG. 1, in which the shank strip will extend from the heel breast region of the shoe to approximately the ball portion.

Figure 3:
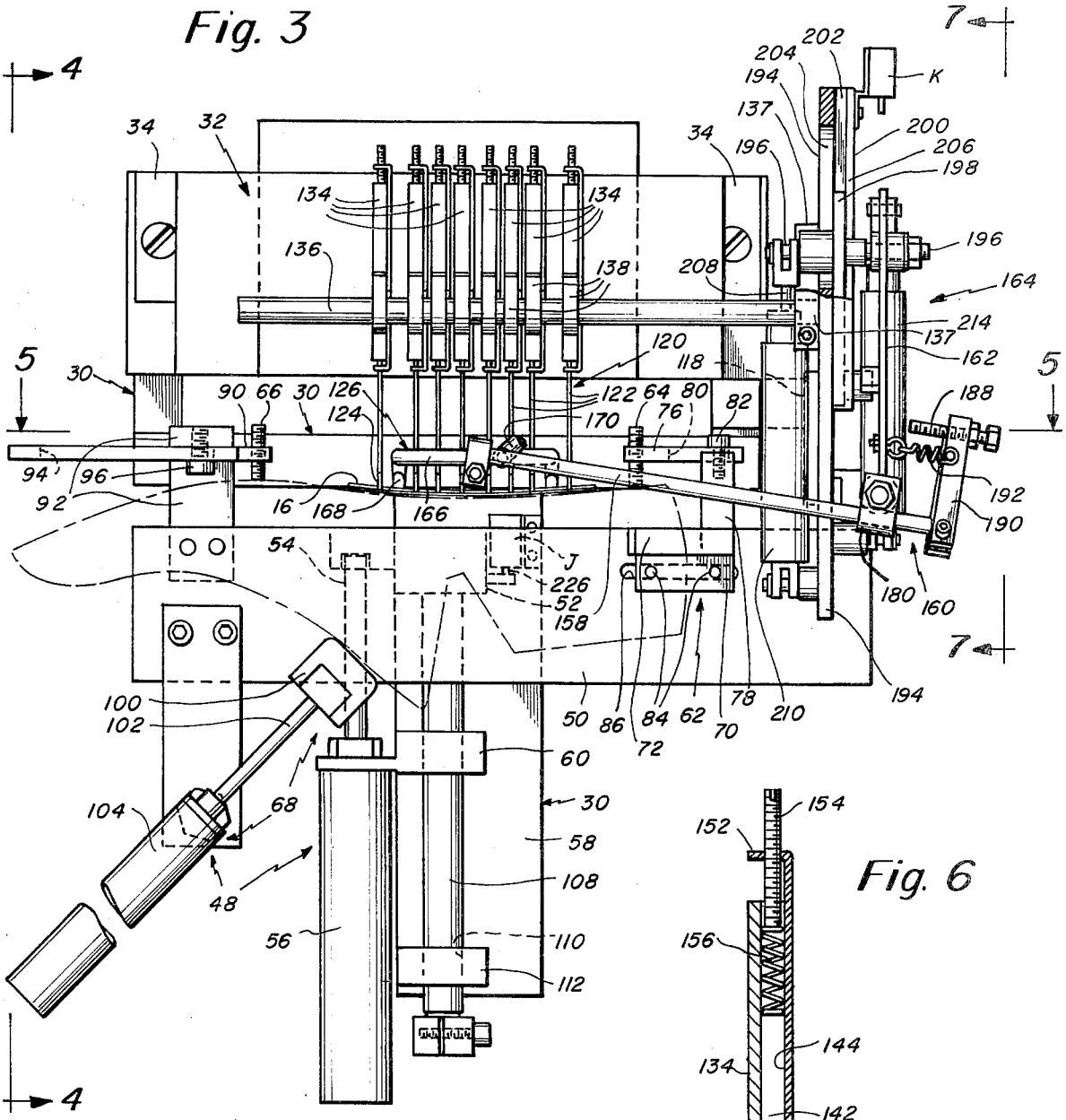
FIG. 3 is a side elevation of the machine with the shoe assembly illustrated in phantom and with the shoe in a raised position but before the strip transfer mechanism has been retracted.

The machine is illustrated, in elevation in FIG. 3 and includes a frame 30 which may be secured to a base (not shown) or other appropriate firm support. For ease of description, directions extending to the left as seen in FIG. 3 will be referred to as forward or toeward and directions extending to the right will be considered as heelward or rearward. Directions toward and away from the operator's normal position (in which the machine would appear as suggested in FIG. 3) will be referred to as lateral, transverse, or widthwise.

A radiant energy source, such as an infrared heater 32 is secured to the frame, for example, by a bracket 34. The heater 32 preferably is in the form of an elongate infrared heating element 36 (FIG. 4) within a reflector 38 which will direct the infrared radiation downwardly toward a shoe assembly (shown in phantom in FIG. 3) which is supported bottom-up in the machine. The radiant heater 32 and its reflector 38 are selected and arranged to direct the radiant energy downwardly toward the shoe bottom when the shoe is supported in the machine as shown. As will be described, the position of the heater with respect to the shoe assembly, when the shoe assembly is positioned in readiness for activation of the shank strip, is such that the shoe bottom will be displaced from the focal point of the reflector so that the radiation from the heater 32 will impinge on the shoe bottom and elongate strip pattern which will substantially coincide with and include the resin-containing portion of the shank strip 16.

The bracket 34 may be attached to a rearwardly extending threaded rod 35 which is secured to an upwardly extending portion 37 of the frame 30. Frame portion 37 preferably is provided with a heightwise extending slot 39. A pair of nuts 40 are threaded onto the rod 35 on opposite sides of frame portion 37 to secure the rod 35 to the frame section 37. The foregoing mounting enables the position of the heater 32 to be adjusted both laterally as well as vertically.

The shoe assembly is held firmly in the machine by a shoe jack assembly, indicated generally by the reference character 48. The shoe jack assembly is guided for vertical movement (as will be described) toward and away from the heater 32, between a lowered loading, position and a raised operating position (shown in FIG. 3). The shoe jack assembly includes a forwardly-rearwardly extending main support bar 50 having a bracket 52 which is driven by the piston rod 54 of an air cylinder 56. The piston rod 54 is not rigidly attached to the bracket 52 but, rather, is received within a blind bore 53 formed in the underside of the bracket 52. The air cylinder 56, in turn, is secured to a portion 58 of the frame 30, by a bracket 60. The main support bar 50 carries the various shoe clamping elements which include a V-shaped heel locator 62, heel pin 64, a pair of ball pins 66 and a cone clamp 68 which secures the shoe assembly with its heel pressed firmly into the heel locator 62, with the heel seat of the shoe firmly against the heel pin 64 and the ball portion of the shoe firmly against the ball pins 66. When in the clamped position (as shown in phantom in FIG. 3), operation of the air cylinder 56 raises or lowers the entire shoe jack assembly thus raising or lowering the shoe assembly.

The heel locator 61 is mounted to the main support bar 50 by a forwardly extending bracket 70 (see FIG. 5) and determines the rearward position of the shoe assembly by engagement with the quarter portions. The heel locator 62 includes a pair of heel plates 72 secured to the bracket 70 at approximately right angles to each other. The heel pin 64, which determines the heightwise location of the heel portion of the shoe assembly is threaded through the forwardly extending end of a member 76. The member is secured to the bracket 70 by an upwardly extending post 78. The heel pin 64 is intended to engage the heel seat of the shoe assembly substantially along the longitudinal center line of the shoe and is located intermediate and above the heel plate 72. The forward-rearward position of the heel pin 66 may be adjusted, if desired, by a slot 80 in the member 76 and a bolt 82 which passes through the slot 80 and secures the member 76 to the post 78. In addition to the foregoing adjustments, the bracket 70 may be adjusted as to its longitudinal position thereby providing an adjustment of the assembly of the heel locator 62 and heel pin 64. To this end, the bracket 70 is secured to the main support bar 50 by a pair of bolts 84 which pass through a forwardly-rearwardly extending slot 86 in the support bar 50.

The heightwise position of the toe end of the shoe assembly is determined by the ball pins 66 which are laterally spaced and threaded. The pins 66 are threaded through a T-shaped plate 90 (FIG. 5) which is supported by a bracket 92 which, in turn, is mounted to the main support bar 50. The longitudinal locations of the threaded pins 66 may be adjusted by the arrangement of a slot 94 formed longitudinally through the plate 90 and a screw 96 which extends through the slot and is threaded into the bracket 92.

The shoe assembly is urged upwardly and rearwardly against the heel locator 62, heel pin 64 and ball pins 66 by a cone clamp, indicated generally at 68. The cone clamp 68 includes a cone clamp pad 100 which is secured to the end of a piston rod 102 of an air cylinder 104. The air cylinder 104 is suspended from the main support bar 50 by a bracket 106. The air cylinder 104 is mounted at an angle such that the clamping pad 100 will move along an upwardly and heelwardly directed path toward (and away) from the cone portion of the shoe thus providing both an upward and rearward component of clamping force. With this clamping arrangement, in which the clamp is located forwardly of the heel region of the shoe assembly, the machine may be used with equal facility, either with low cut shoes or with boots because there are no clamping mechanisms which would interfere with placement of boots in the machine.

The shoe jack assembly is guided in its vertical movement by a guide rod 108 which is secured to the bracket 52 and slides through openings 110, 112 formed in bosses 112, 113 respectively which are part of the frame portion 58. In order to prevent horizontal rotation of the shoe jack assembly, a stabilizer 114 (FIG. 5) is secured to the rearwardmost end of the main support bar 50 and is received in a slot formed in a guide 116 which is attached to a plate 118 which is supported in a fixed position with respect to the frame.

The machine also includes a pair of generally paralleling strip engaging means, indicated generally by the reference character 120, which are constructed and arranged to engage the opposite marginal portions 28 of the shank strip 16 and cooperate to urge the marginal portions 28 downwardly into engagement with the insole bottom. In the embodiment shown, and as described more fully herein, the shank strip engaging means comprises a pair of generally paralleling rows or groups of spaced fingers 122 having ends 124 which will engage the opposite margins 28 of the shank strip when the shoe and strip are raised toward the heater 32 to an activating position. The fingers 122 are disposed below the radiant heater 32 but well above the location of the shoe assembly when the shoe assembly is clamped in the shoe jack assembly 48.

When an operating cycle of the machine is initiated, a shank strip 16 will be suspended below the ends 124 of the fingers but above the bottom of the shoe assembly which then is supported in the shoe jack 48. The shank strip 16 is suspended by the transfer head portion (indicated generally at 126 in FIG. 3) of the shank strip transfer mechanism. The transfer head 126 is constructed to retain the shank strip by suction. Thereafter, as the shoe jack assembly 48 is operated to raise the shoe, the insole engages the shank strip 16 and they continue to move upwardly in unison, under the influence of air cylinder 56. The shank transfer head 126 is movably mounted so that it too will move upwardly with the shoe assembly and shank strip. The shoe assembly and shank strip continue to move upwardly until the margins 28 of the shank strip 16 engage the ends 124 of the fingers 122. The fingers 122 also are mounted for heightwise movement in response to continued upward advancement of the shoe jack 48 and shoe assembly. The upper limit of travel of the shoe jack assembly 38 is controlled by a stop screw 128 which extends upwardly from a bracket 130 which is secured to the lower end of the stabilizer rod 108. Stop screw 128 is located so that it will abut against a portion of the frame 30.

When the shoe has been raised to its most upward position, the shank strip transfer mechanism releases its vacuum grip on the shank strip and is moved upwardly and laterally away from the shoe assembly to the remote position indicated in phantom in FIG. 4 and in a manner which will be described in more detail.

Figure 9:
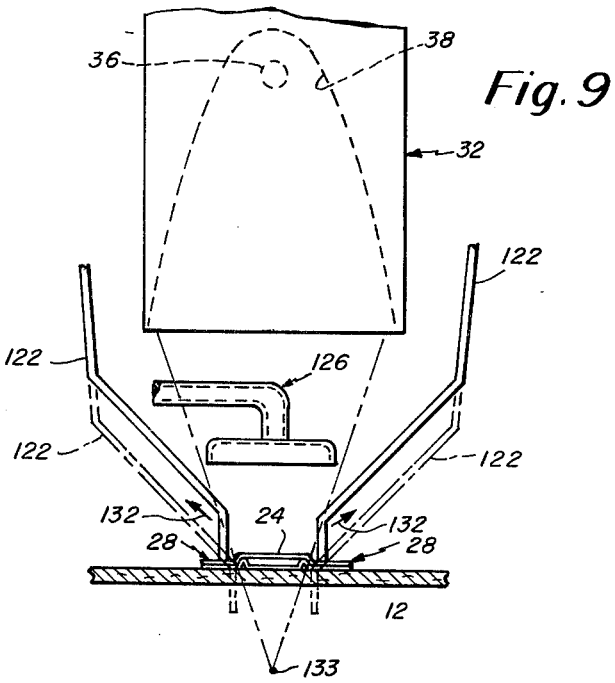
FIG. 9 is a somewhat diagrammatic illustration of the relative heightwise and lateral positions of the fingers as seen longitudinally of the machine.

FIG. 9 illustrates, somewhat diagrammatically, the manner in which the fingers 122 are engaged by and move with respect to the margins 28 of the shank strip 16. As the shoe assembly is raised, the ends 124 of the fingers initially engage the margins of the shank strip while the fingers 122 are in the position shown in phantom in FIG. 9. Fingers 122 are mounted for heightwise movement in response to the rising shoe assembly but in a manner which also provides for a slight component of laterally outward movement as suggested by the arrows 132 in FIG. 9 and the fingers as shown in solid. The effect of this movement of the fingers 122 is to impart a lateral drag to each of the margins to tend to laterally tension the top strip 24 of the shank strip 16. That provides certain advantages as described in the aforementioned application Ser. No. 765,095 and as will be described herein.

Figure 6:
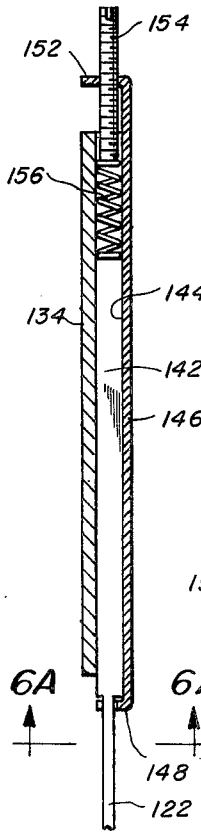
FIG. 6 is a sectional view of one of the finger guides as seen along the line 6—6 of FIG. 4.
Figure 6A:
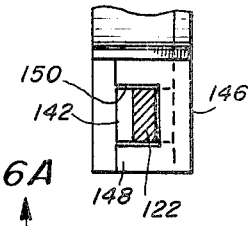
FIG. 6A is a partly sectional bottom view of the finger and finger guide as seen along the line 6A—6A of FIG. 6.
Figure 4:
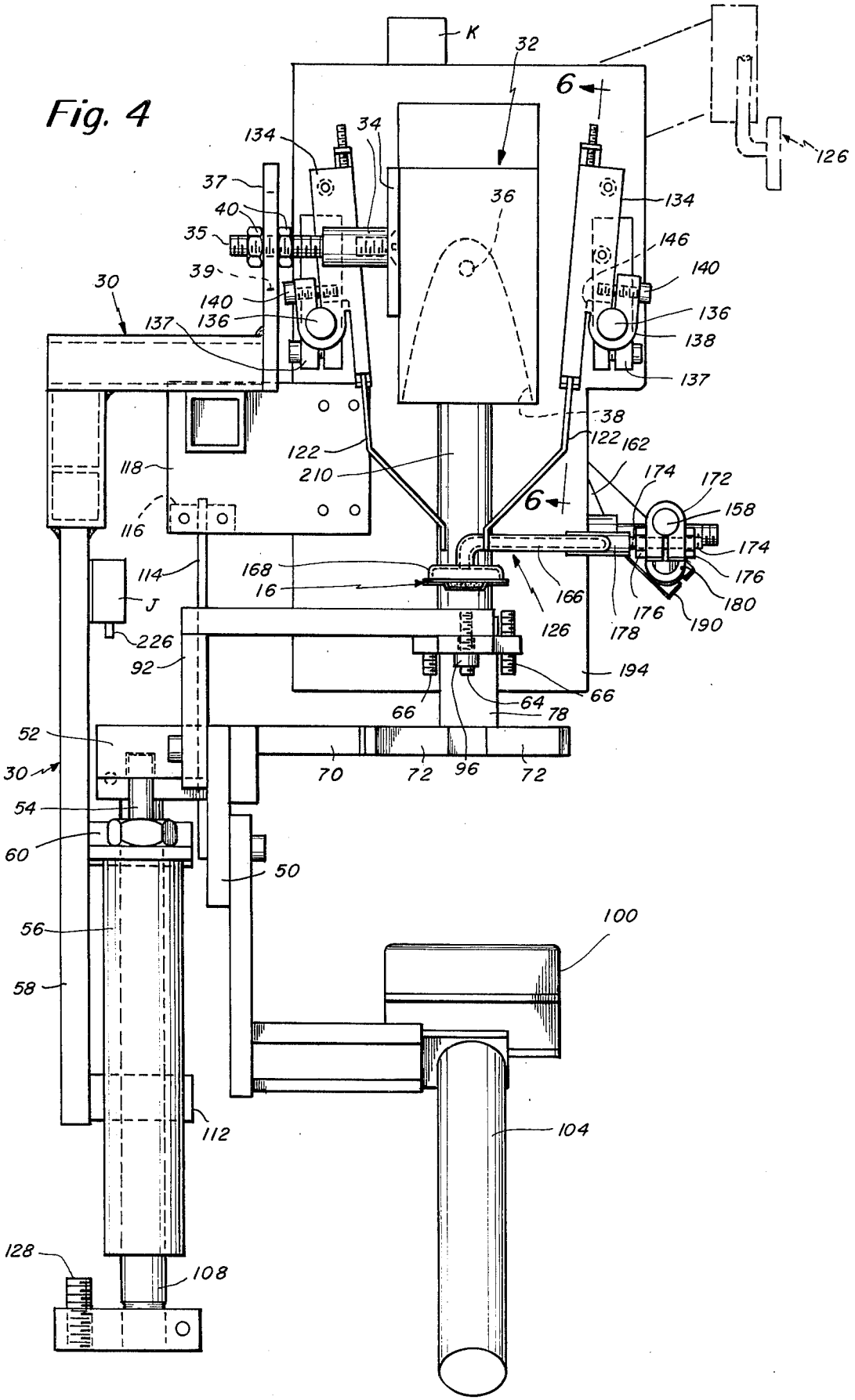
FIG. 4 is a front elevation of the machine when in an idle position.

FIGS. 3, 4 and 6 show the constructional details of the fingers 122 and the manner in which they are mounted. Each of the fingers is carried by a finger guide 134 which, in turn, are mounted on a pair of laterally spaced forwardly-rearwardly extending rods 136. Each of the rods is secured, at its rearward end, to the frame by a clamp 137. Each of the finger guides 134 includes an integral clamp portion 138 by which the finger guides are secured in a fixed and rigid position on the rods 136. The angular attitude of the finger guides 134 and their longitudinal position along the rods 136 may be adjusted by loosening clamp screws 140, repositioning the finger guides 134 as desired and then retightening the screws 140. As shown in FIG. 6, each of the fingers includes an upper portion 142 which is slideably received within a slot 144 extending through the finger guide 134. The upper portion 142 of the finger is noncircular in cross section and is preferably square (as is the slot 144) to preclude the fingers from rotating within their finger guides 134. The lower protruding portion 122 of the fingers are narrowed to a more rectangular configuration (FIG. 6A) than the upper portion 142. Each of the finger guides 134 is provided with a cap member 146 having a lower flange 148. The lower flange 148 is provided with a slot 150 which receives the narrowed lower portion of the finger 122 but which cannot pass the enlarged upper portion 142, thereby limiting the lower position of the fingers in the guides 134. The cap member 146 also includes an upper flange 152 which overlies the upper end of the finger guide 134 and which receives a tensioning screw 154 which extends into the upper end of the slot 144. A compression spring 156 is disposed in the upper end of the slot 144, between the upper end of the upper finger portion 142 and the screw 154 to lightly bias the finger in its lowermost position. The screw 154 may be adjusted to vary the force developed by the spring 156 as may be desired.

From the foregoing, it will be appreciated that the finger guides 134 and, therefore, the fingers 122 may be spaced as desired along the rods 136 and may be oriented at a downwardly and inwardly inclined attitude to the extent desired. In most instances, it will only be necessary to make an initial adjustment which will ordinarily be sufficient for substantially all shoes to be manufactured in accordance with the invention. The fingers 122 are formed to be relatively stiff, at least in a lateral direction, so that when the shoe assembly urges the fingers 122 upwardly, they will not bend in a lateral direction. This is desirable in order to assure that control over the extent to which the fingers 122 move laterally outward is achieved solely by the angular attitude of the finger guides 134.

Figure 15:
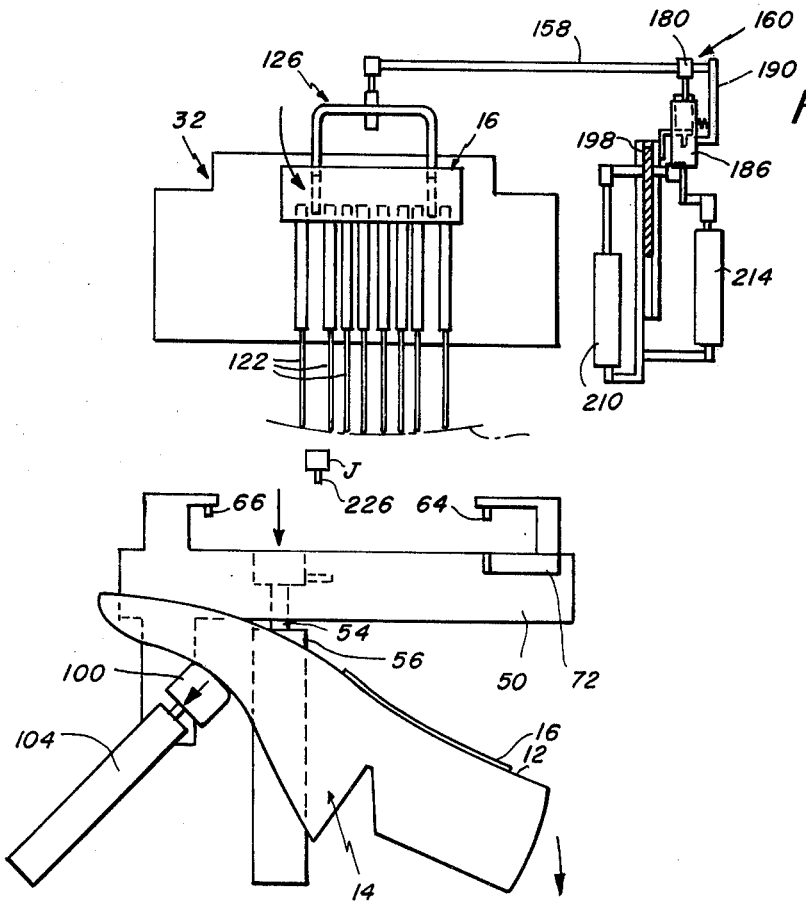

It is preferred that the relatively light force (e.g., 1–2 ounces) with which the fingers 122 press the margins 28 against the insole be generally uniform and, to this end, the fingers 122 may be formed so that the lower ends 124 of the more intermediate fingers 122 in each group extends somewhat lower than the ends 124 of the more toeward and heelwardly disposed fingers 122. Thus, the finger ends 124 in each group define a locus 125 (see FIGS. 10, 15) which correspond approximately to the curvature of a shoe bottom in the shank region of a shoe assembly. By initially arranging the locus 125 of the ends of the fingers 124 to approximate the curvature of the shoe bottom, from the ball region to the heel breast region, a substantially uniform pressure will be applied to the margins of the shank strip when the shank strip and shoe assembly are brought into engagement with the fingers.

The transfer mechanism is illustrated in FIGS. 3, 5, 7 and 8 includes the transfer head 126, arm 158, elbow joint 160, driver lever 162 and drive mechanism 164. The transfer head 126 is connected to the end of the arm 158 in a manner which permits pivotal self-adjustment of the head 126 about a transverse axis to enable the transfer head to accommodate itself to the contour of the insole of the particular shoe assembly. The elbow joint 160 enables the arm 158 to pivot upwardly in unison with the shoe assembly during the last portion of the rise of the shoe assembly. The drive mechanism 164 and drive lever 162 are arranged to continue subsequent rising movement of the arm 158 and transfer head 126 and then to rotate the entire transfer assembly transversely and upwardly out of the way to its remote position.

The transfer head 126 may be in the form of a U-shaped tube 166. The outer end of each leg of the U-shaped tube 166 is bent at right angles to the leg and is provided with an elongate suction pad 168. The tube 166 is connected to a vacuum source (not shown) by appropriate tubing 170. When the transfer mechanism is in the remote position shown in phantom in FIG. 4, the tube 170 is connected to the vacuum source to generate a suction at suction pads 168. When in that configuration, a precut shank strip 16 may be applied by the operator to the suction pads 168 which will hold the shank strip. As will be described, the transfer mechanism then is rotated downwardly to transfer and position the shank strip 16 above the shoe assembly and below the fingers 122. The suction will remain on to securely hold the shank strip until it is desired to release the shank strip 16 and return the transfer mechanism to its out-of-the-way, remote position.

The suction pads preferably are of a length which is substantially equal to the width of the shank strip as that facilitates proper registration of the shank strip on the shank pads when the transfer mechanism is in its remote position. The operator need only align the edges of the shank strip margins 28 with the ends of suction pads 168. It also should be noted that the fingers 122 are adjusted longitudinally on their rods to assure adequate clearance between the legs of the U-tube 166 so that it will not interfere with the fingers 122 at any time during the movement of the transfer mechanism.

Figure 5:
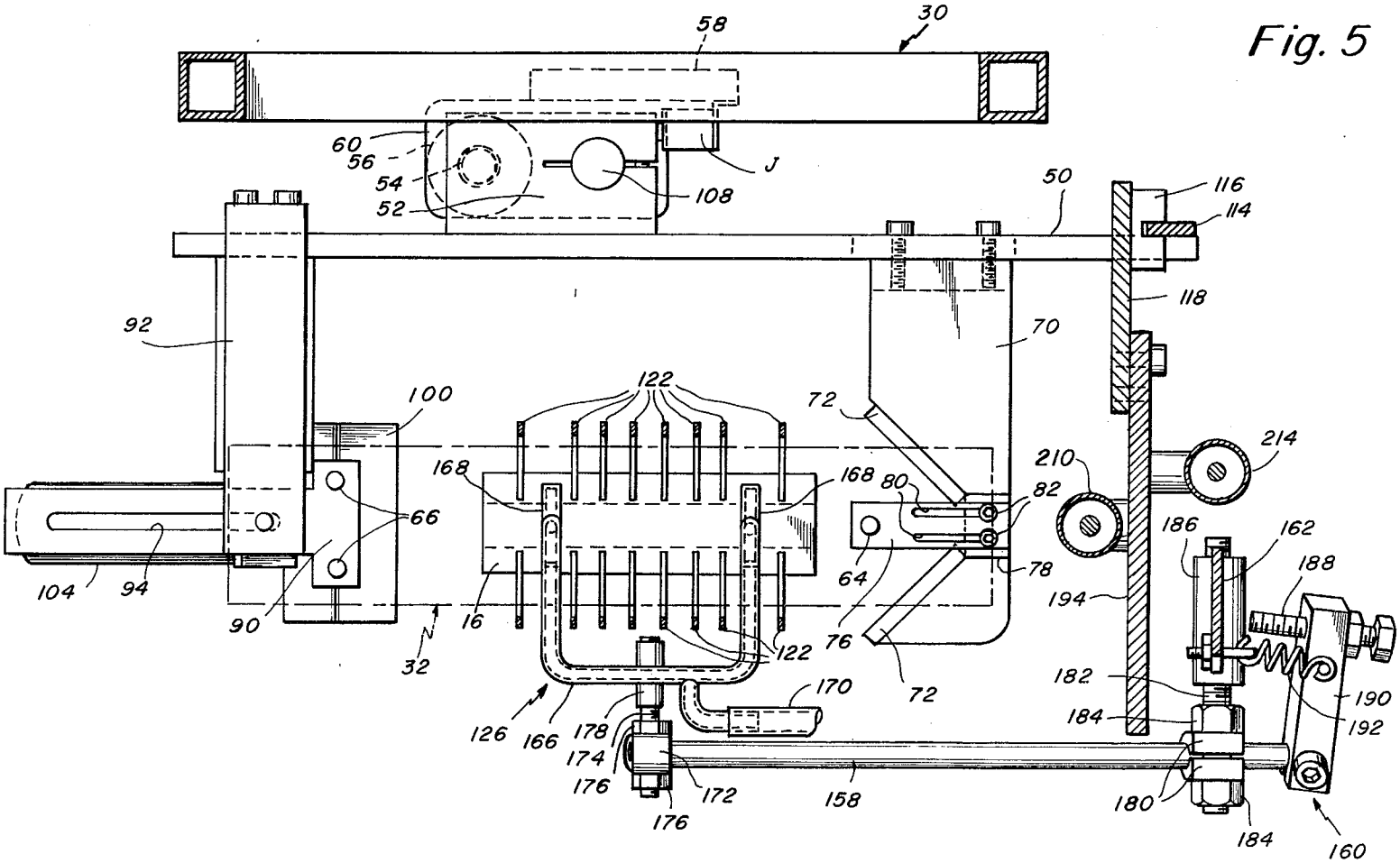
FIG. 5 is a partly sectional, plan view of the machine as seen along the line 5—5 of FIG. 3.
Figure 7:
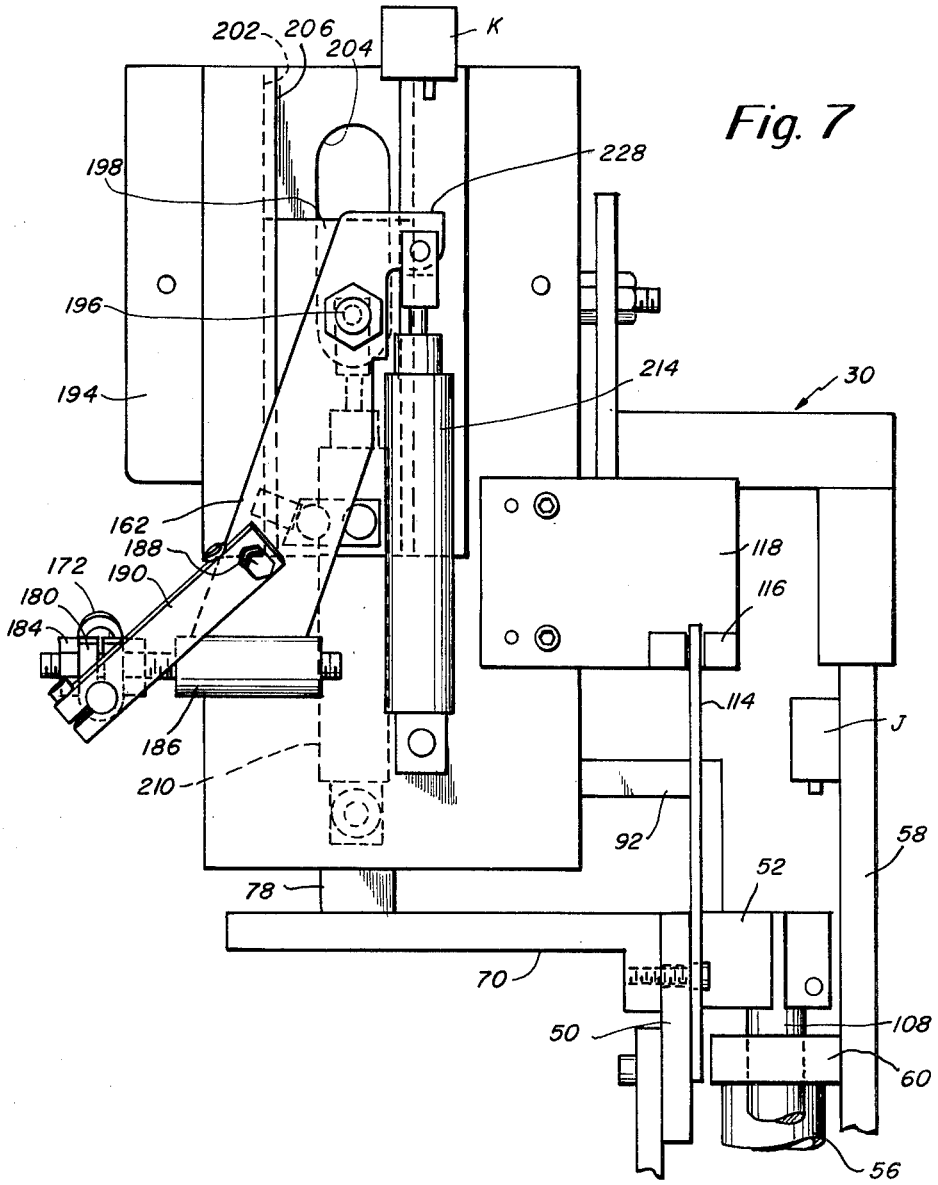
FIG. 7 is a rear elevation of the strip transfer drive mechanism in its lowered configuration.
Figure 8:
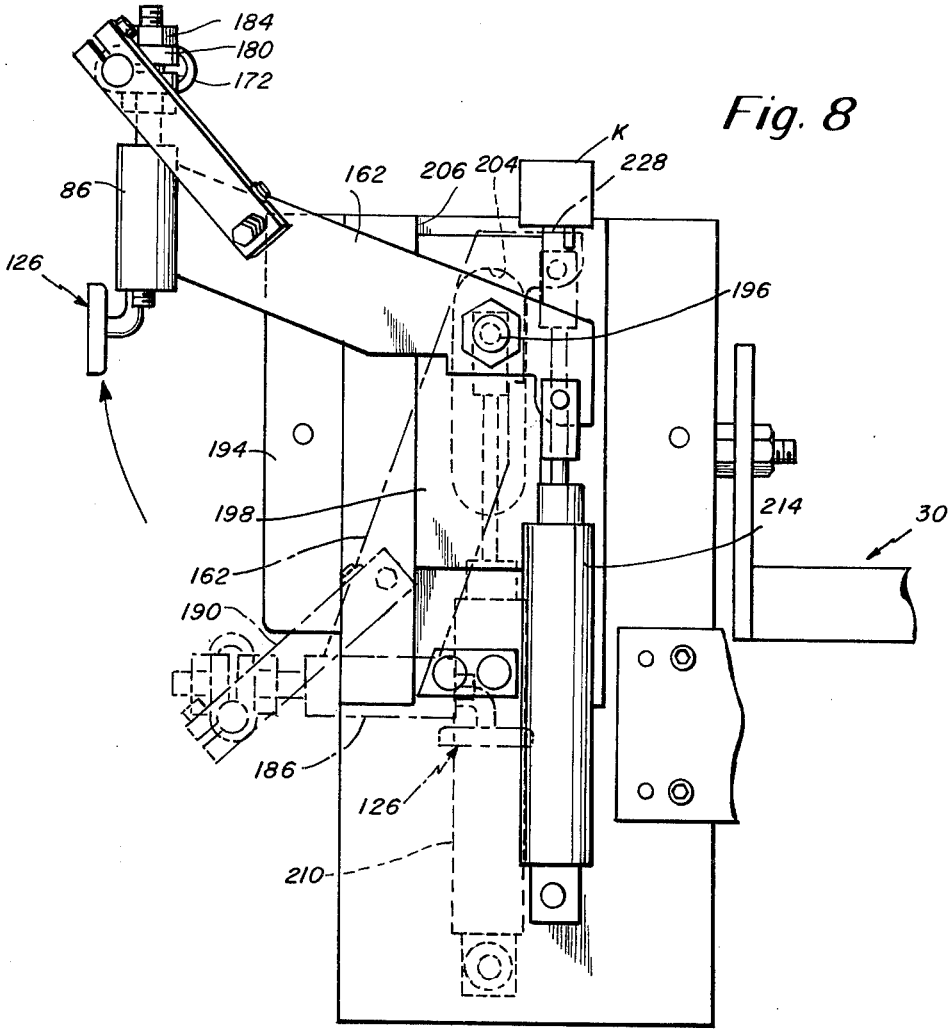
FIG. 8 is a rear elevation of the strip transfer drive mechanism in a retracted, remote position.

The transfer head 126 is mounted to the end of the arm 158 by a connection which will permit a limited amount of pivotal movement about a transversely extending axis (as seen in FIGS. 4 and 5). This is desirable to enable the transfer head 122 to conform itself to the particular shape and contour of the shoe insole to which the shank strip is to be applied. The connection includes a clamp 172 which is secured to the outer end of the arm 158. The clamp is secured by a transversely extending screw 174 and a pair of locknuts 176. The U-tube 166 has an integral threaded sleeve 178 which is mounted to an inwardly extending end of the screw 174 so that the sleeve 178 may pivot directly on the screw 174.

The elbow joint 160 is arranged to permit the arm 158 to swing upwardly together with and in response to upward movement of the shoe assembly. The elbow joint 160 includes a clamp 180 which is secured to the other end of the arm 158 by a screw 182 and a pair of locknuts 184. The screw 182 is freely threaded into a sleeve 186 which is formed integrally with and at the lower end of the drive lever 162. The freely threaded connection between the sleeve 186 and screw 182 enables the arm 158 to pivot so that it may be raised or lowered in response to movement of the shoe. Means are provided to limit the lowermost pivotal position of the arm with respect to the sleeve 186 and drive lever 162, so that the lever may be raised and pivoted (as will be described) to draw the arm 158 and transfer head 126 to their remote position. The limiting mechanism includes an adjustable threaded stop screw 188 which is threaded through an end of an arm extension member 190, secured to the opposite end of the arm 158. The member 190 is disposed at an angular attitude with respect to the arm 158 such that the stop screw 188 will face the rearwardly facing surface of the drive lever 162. In the absence of a shoe assembly to support the transfer head end of the arm 158, screw 188 will bear against the side of drive lever 162. As the shoe assembly advances upwardly, the arm 158 pivots upwardly to move the stop screw 188 away from the drive lever 162 (as suggested in FIG. 5). When the lever 162 is subsequently raised and rotated (as will be described) to retract the transfer mechanism, the stop screw 188 will again be brought into engagement with the drive lever 162 so that continued movement of the lever 162 will withdraw the transfer arm 158 and transfer head 126. The arm 158 is biased in a downward direction by means of a tension spring 192 which is connected at one end to the arm extension member 190. That assures a good, firm contact between the transfer head and the shoe assembly.

The drive mechanism 164, for moving the arm 158 and transfer head 126 between its operative and remote positions, includes an arrangement by which the drive lever 162 first may be moved upwardly until the transfer head has adequately cleared the shoe assembly and then rotated in a lateral and upward direction to its remote position. To this end, the drive mechanism 164 is supported on a plate 194 which is secured to the frame at the rear end of the machine. The drive lever 162 is pivotally mounted, between its ends at a first pivot 196 to a slide 198 which is movable vertically along the rear surface of the plate 194. The slide 198 is confined to vertical movement by a pair of vertically extending gibs 200, which are secured to the plate 194 and define a pair of heightwise extending guideways 202 which receive and guide the slide 198. The pivot 196 consists of an elongate rod which extends in a forward-rearward direction and on opposite sides of the plates 194, 200. The plate 194 is provided with a vertically extending opening 204 to permit the pivot 196 to move freely in a vertical direction. The more forwardly disposed end of the pivot pin 196 is connected to the piston rod 208 of an air operated slide cylinder 210. The lower, other end of the slide cylinder 210 is pivotally secured to the plate 194. The outermost end of the drive lever 162 is pivotally connected, at a second pivot, to the piston rod 212 of another air operated cylinder 214 which is located on the rearward side of the plate 194 and is pivotally secured at its lower end to the plate 194.

The cylinders 210, 214 are operated in a manner which first raises the drive lever 162 (and the positioning members carried thereby) and then pivots the drive lever 162 about the pivot 196 toward the remote position where it is maintained for a time interval (during the heat activation cycle) sufficient to enable the operator to load the transfer head 126 with a new shank strip. Thus, air cylinders 210 and 214 are operated simultaneously to advance the drive lever 162 upwardly (without rotation) until the upper end of the lever 162 engages an actuating member 230 of a valve K, mounted to the upper end of the rearward plate 200. The valve K is incorporated in the control circuitry of the machine (as will be described) to maintain the cylinder 210 in its piston-extended configuration, but to reverse operation of the cylinder 214, thereby retracting the piston rod 212 and causing the driver lever 162 to rotate upwardly about the pivot 196 until the lever 162 reaches its idle position.

Figure 10:
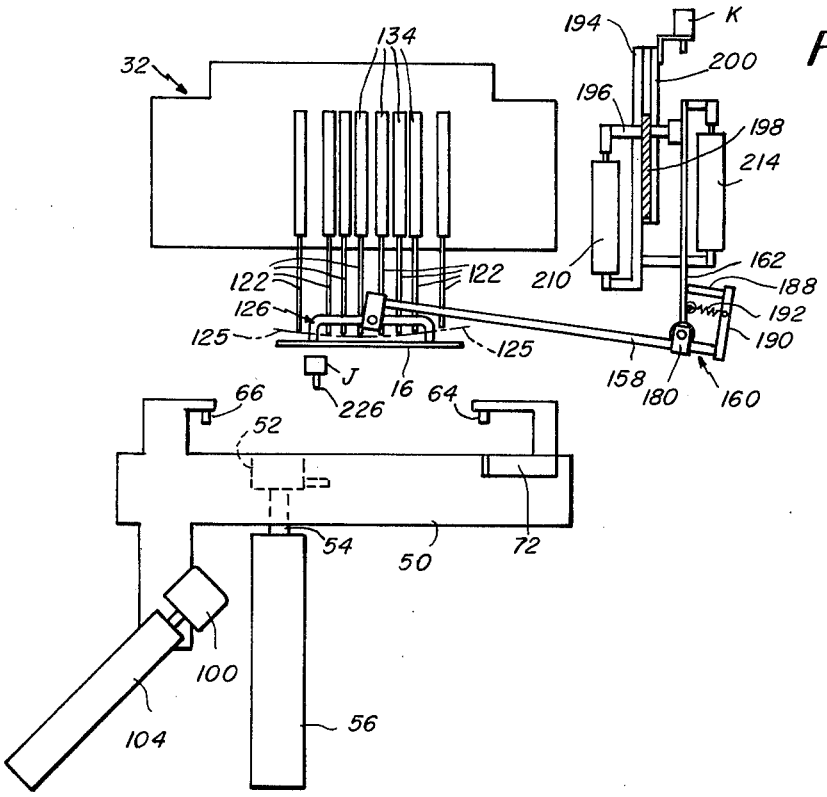
FIGS. 10–15 are somewhat diagrammatical illustrations of the sequence of operation of the machine.
Figure 16:
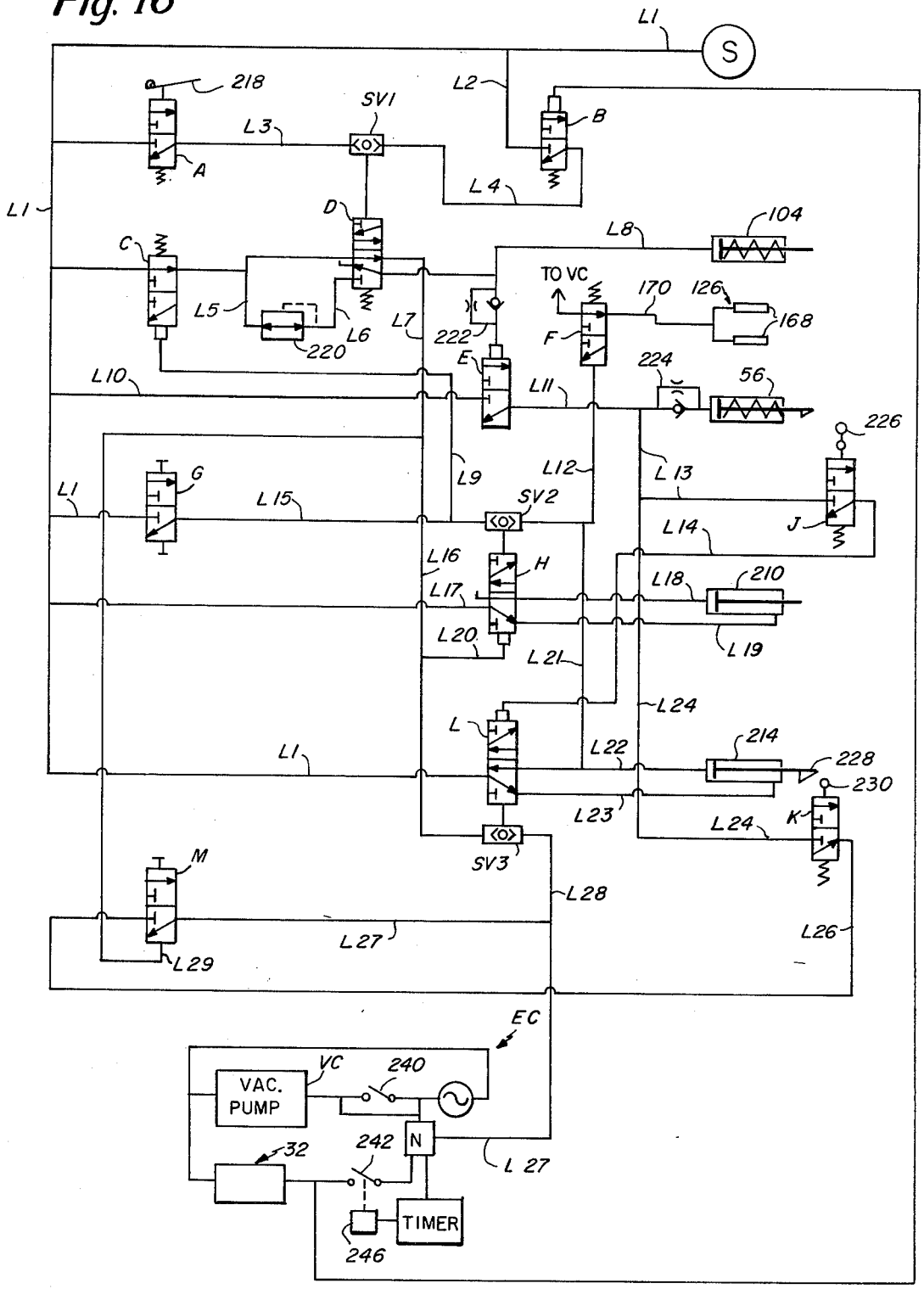
FIG. 16 is a schematic diagram of the control circuitry for the machine.

The sequence of operation of the various elements of the machine is illustrated, somewhat diagrammatically, in FIGS. 10–15, and in FIG. 16 which is a schematic diagram of the pneumatic control circuitry when the machine is in an idle configuration with all valves considered as being in a returned configuration. FIG. 10 shows the machine in its idle configuration, ready to receive a last. The fingers 122 are in their full downward positions. The transfer mechanism is in its lowered position to suspend a shank strip in place below the finger ends 124. Air under pressure is applied from an appropriate source S through line L1 to the various valves which control operation of the machine. At this time, the cone clamp cylinder 104 is biased (by an internal spring) in its retracted configuration, the head end of the cylinder 104 being exhausted through a line L8 and a valve D. The jack cylinder 56 also is spring biased to a retracted configuration (by an internal spring) through a line L11 and a valve E. The vacuum head 126 is connected to a vacuum pump (not shown) through vacuum hose 170 and a valve F. The slide cylinder 210 is maintained in its retracted position by air pressure applied to the rod end of cylinder 210 through a line l19, a valve H and a line L17 which is connected to line L1. The head end of slide cylinder 210 is exhausted through a line L18 and valve H. The lever cylinder 214 also is maintained in its retracted configuration by applying pressure to the rod end of cylinder 214 through a line L23 and a valve L which is connected to line L1. The head end of lever cylinder 214 is exhausted to atmosphere through a line L22 and valve L.

Figure 11:
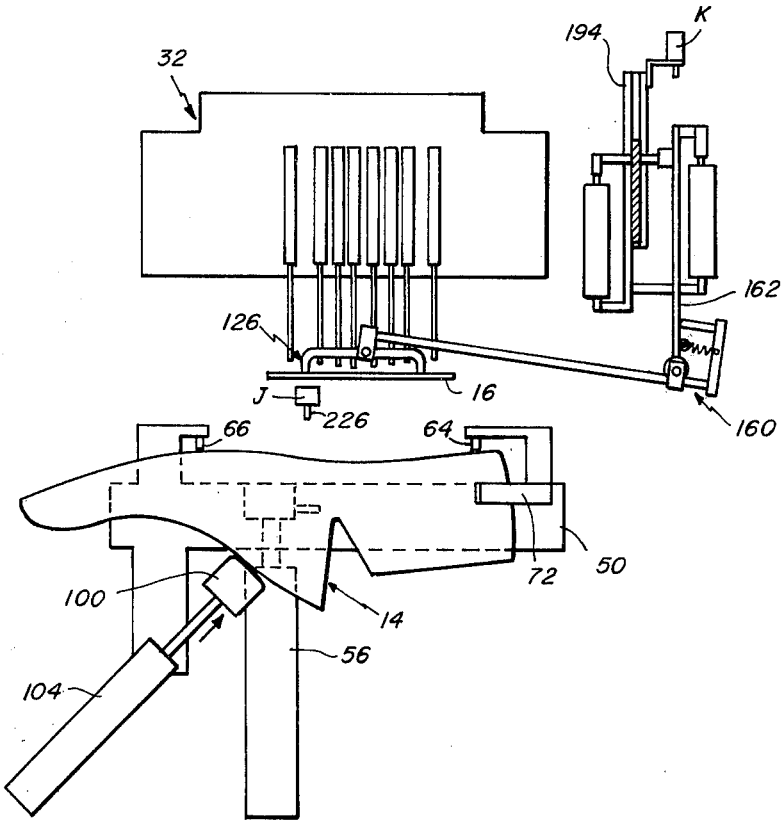

The shoe assembly then is placed on the shoe jack assembly and the operator actuates the clamp cylinder 104 to press the cone clamp 100 to the cone of the shoe assembly and secure it in the jack as shown in FIG. 11. Operation is initiated by shifting a valve A (by a foot treadle not shown but suggested at 218 in FIG. 16). Shifting valve A communicates air from line L1 to line L3 which, in turn, pilots valve D through a shuttle valve SV1. Shifting of valve D enables air to flow from valve C, through lines L5 and L6, through valve D to line L8 to actuate the cone clamp cylinder 104. A pressure regulator 220 is disposed between lines L5 and L6 to limit the force with which the cone clamp cylinder 104 will apply clamping pressure to the cone portion of the shoe upper. This is to reduce any tendency for the cone clamp pad to scrape or damage the upper.

Figure 12:
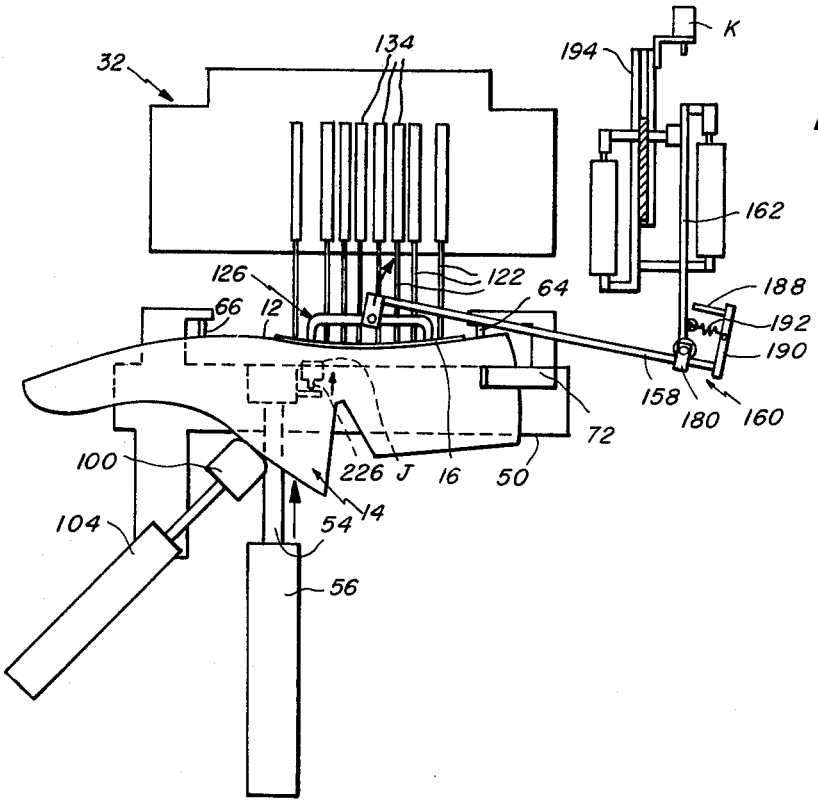
Figure 13:
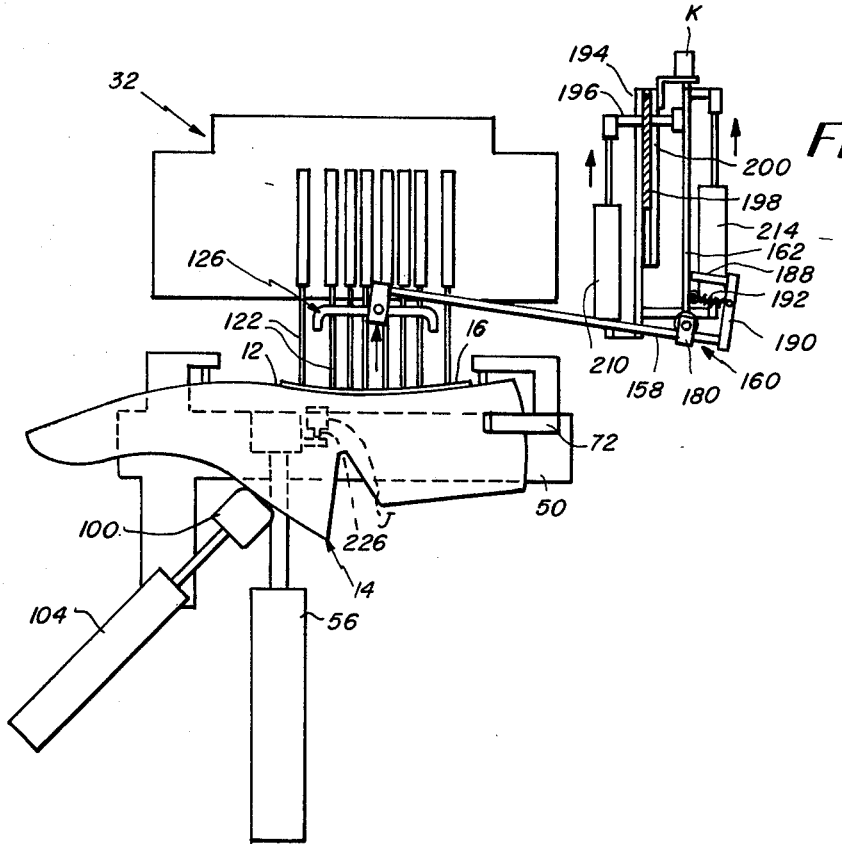
Figure 14:
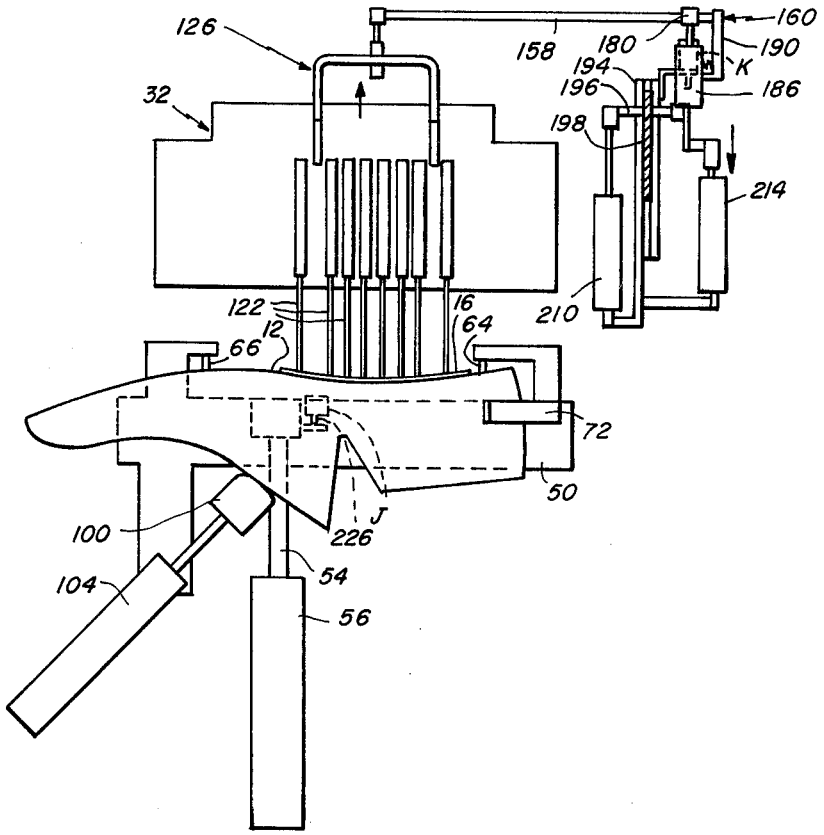

As shown in FIG. 12, the jack cylinder 56 then is operated to raise the shoe jack assembly 48 and shoe assembly into engagement with the shank strip 16. The jack cylinder 56 also is operated in response to shifting of valve D but its operation is delayed slightly to insure that the cone clamp cylinder 104 will have first firmly clamped the shoe in the jack assembly 48. When pressure is applied through line L8, it also is applied to pilot a valve E, but through a flow restrictor 222 to delay slightly the shifting of valve E. Once valve E is shifted, line pressure from line L1 is communicated through line L10 and valve E to the head end of jack cylinder 56. In order to control the speed with which jack cylinder 56 rises, a flow restrictor 224 may be interposed in line L11, just in advance of the jack cylinder 56. It may be noted that when valve E is shifted, pressure also is applied through line L24 to a valve K in readiness for later shifting of valve K.

As the jack 48 and shoe assembly rise, the insole bottom will be brought into engagement with the shank strip 16 and the transfer head may pivot slightly about a lateral axis into conformity with the insole bottom. As the shoe assembly continues to rise under the influence of jack cylinder 56, it will urge the shank strip 16, transfer head 126 and transfer arm 128 upwardly in unison. As the shoe assembly continues to rise, the margins 28 of the strip engage the ends 124 of the fingers 122 to press the margins against the finger ends 124 and urge the finger ends upwardly against the relatively light biasing force of the finger springs 156. When the shoe has been raised to its maximum heightwise position, the fingers 122 will bear down on the margins 28 to press the margins into conformity with the contour of the shoe bottom. In addition, during the raising of the fingers 122, the fingers advnace slightly laterally outwardly to impart a light tension to the margins and, particularly, across the upper strip 24 of the shank strip 16.

When the shoe assembly has reached its most upward position a portion of the bracket 52 will engage and trip an actuating member 226 of a valve J which is incorporated in the control circuitry to operate the cylinders 210, 214 of the drive mechanism 264. The cylinders 210, 214 are actuated first in unison to raise the arm 162 sufficiently to clear the shoe assembly (FIG. 13) and then lever cylinder 214 is reversed to cause the drive lever 162 to pivot about the pivot 196 thereby swinging the arm 158 and transfer head 126 laterally and upwardly to its remote position, in readiness to receive the next shank strip. As shown in FIG. 16, when valve E shifts to actuate the jack cylinder 56, air also is applied through line L13 to valve J. When the jack cylinder is raised to its uppermost position and actuates member 226 of valve J, air flows through line L13, valve J and through line L14 which shifts valve L. Shifting of valve L, in turn, directs air from line L1, through valve L and through line L22 to the head end of lever cylinder 214 and also exhausts the rod end of lever cylinder 214 through line L23 and valve L. When pressure is applied to line L22, it also is applied, through line L21 to a shuttle valve SV2 which shifts valve H. Shifting of valve H communicates air to the head end of slide cylinder 210 through line L18, valve H and line L17 and line L1. The rod end of slide cylinder 210 is exhausted through valve H. In addition, the vacuum source is disconnected from the transfer head 126 to permit the suction pads 168 to release the shank strip 16, thereby enabling the shank strip 16 to remain on the bottom of the shoe insole as the transfer mechanism is retracted. The vacuum is disconnected simultaneously as lever cylinder 214 is actuated. When valve L is shifted to direct air to the head end of cylinder 214, air is also directed through line L21 to line L12 which deactivates valve F and enables it to connect line 170 to exhaust.

It may be noted that lever cylinder 214 will be actuated just slightly before slide cylinder 210 is actuated. This insures that the lever 162 will be biased in its most downward position to assure that there will be no rotary component of motion applied to the transfer mechanism until it is desired to swing that mechanism out of the way. The slide cylinder 210 and lever cylinder 214 thus are operated in unison to raise the slide 198, pin 196, lever arm 162. The lever arm 162 and drive mechanism 164 will rise until the stop screw 188 of the elbow joint 160 engages the rearwardly facing side of the level 162. The freedom of pivotal motion provided by the elbow joint 160 and pivot rod 174 permit the transfer arm 158 to move as required. When the stop screw 188 engages the lever 162, the transfer arm 158 will no longer be able to pivot with respect to the lever 162 and continued rising movement of the lever 162 will also raise the transfer arm 158 and transfer head 126.

The cylinders 210 and 214 continue to operate in unison until a portion of the lever 162 (indicated diagrammatically at 228 in FIG. 16) trips an actuating member 230 of a valve K mounted to the plate 194. Valve K is interposed in the control circuitry to reverse operation of the lever cylinder 214 to cause the lever arm 162 to pivot about the pivot pin 196 and swing the transfer mechanism laterally and upwardly out of the way to its remote position. When valve K is shifted, air is directed from line L13, through line L24, through valve K and line L26 to valve M. Valve M is a manual, operator-actuated valve which, at this stage in the operation of the machine, will already have been actuated by the operator. The purpose of valve M is to insure that one of the operator's hands has been removed from the shoe jack area, as a safety measure. Assuming valve M has been shifted, air passes through valve M and line L27 to line L28 and to shuttle valve SV3 which shifts valve L to communicate air from line L1 to line L23 and to the rod end of lever cylinder 214. Lever cylinder 214 then pivots the lever 162 about the pin 196 to swing to its remote, out-of-the-way position as suggested in FIG. 14. It may be noted that if the operator has not shifted valve M, the machine will stop in the position illustrated in FIG. 13.

Operation of the radiant heater, to cure the shank strip is initiated as the lever cylinder 214 begins to rotate the transfer mechanism out of the way. As illustrated in FIG. 16, the electrical circuitry (indicated generally at EC) associated with the radiant heater 32 is actuated by a pressure switch N which is connected to pneumatic line L27. Thus, when valve K is shifted to direct air through line L26, valve M, line 27 and to shift valve L, switch N also is actuated to being operation of the heating cycle. The electrical circuitry EC includes a power source and a manually operated main on-off switch indicated at 240. During operation of the machine, switch 240 will be closed to continuously operate a vacuum pump VC which is connected through valve F to apply the vacuum to the transfer head 126. When pressure sensitive switch N is switched by a pulse through pneumatic line L27, that begins operation of a timer which immediately operates a relay 246 to close the switch 242 thereby beginning operation of the heater 32. Concurrently with operation of the heater, a signal is applied to solenoid valve B to shift that valve to communicate air from line L2 through valve B and line L4 to shuttle valve SV1 to pulse valve D and hold valve D in its shifted configuration. That locks valve D in its "treadled" position and the operator may remove his foot from the treadle at that time. The radiant heater continues to operate for a predetermined time interval controlled by the timer.

While the heater 32 is activating the shank strip, the operator may place a new shank strip on the suction pads 168 of the transfer mechanism. In order that the suction pads 168 will retain the new shank strip 16, the pads 168 are reconnected to the vacuum source. This occurs automatically when the lever cylinder 214 is reversed. When lever cylinder 214 is reversed, by shifting of valve L, lines L22, L21 and L12 are exhausted through valve K. That enables the spring biased valve F to return to its original configuration in which the vacuum was connected to line 170.

The electronic timing mechanism will continue to expose the shank strip for a predetermined time interval. At the end of exposure, relay 246 is deactuated to open switch 242 thereby shutting off the heater and terminating the signal to valve B which enables valve D to return to its spring biased configuration in which the cone cylinder 104 returns to its retracted position. Reshifting of valve D also returns valve E which enables jack cylinder 56 ot exhaust through line L11 and valve E so that it, too, returns to its idle configuration in which the jack assembly is lowered. As cylinders 56, 104 return to their idle positions, the shoe assembly is released and will fall into a chute (not shown) which is disposed below the jack assembly to catch the shoe. The lever cylinder 214, which was previously returned to its retracted, idle configuration remains in that state. Retraction of lever cylinder 214 also enables valve K to return which deactuates pressure switch N, in readiness for a new cycle of operation. The slide cylinder 210 is returned to its idle configuration by return of valve H which communicates air from line L1, through line L17, valve H and line L19 to the rod end of the cylinder. The head end of the cylinder is exhausted through line L18 and valve H. Valve H is returned by air from valve D which passes through line L7, and lines 16 and 20 to reshift valve H.

It should be noted that when the transfer mechanism returns from its remote to its lowered position, it will swing about the pivot connection between the lever arm 162 and piston rod of the lever cylinder 214. This defines a larger arc than when the lever swung about pivot 196 and insures that the transfer mechanism will swing the shank strip in an arc which will pass well below the lower ends 124 of the fingers 122. The machine then is ready for the next operating cycle.

In some instances, it may be desirable to swing the shank transfer mechanism from its normal position below the fingers 122 to its upper remote position without running the machine through an entire cycle. For example, this may be desired in the event that the shank strip was not placed properly on the vacuum pads 168 or if for some reason, the operator neglected to place a shank strip on the pads 168. Valve G permits this mode of operation. Valve G is a two-position manually operated valve which will ordinarily remain in the configuration shown in FIG. 16 during normal operations. Should it be desired to swing the transfer mechanism to its remote position, valve G is shifted manually to communicate air from line L1, through valve G into line L15 to shuttle valve SV2 which shifts valve H. Shifting valve H communicates air from line L1 through line L17 and valve H, through line L18 to the head end of slide cylinder 210. Line L19 is exhausted from the rod end of slide cylinder 210 through shifted valve H. Operation of slide cylinder 210 rotates the transfer mechanism (in a relatively wide arc about the pivot connection to lever cylinder 214) to the remote position. In addition, line L15 is connected through line L9 to valve C to shift valve C to thereby shut off air from valve D, to insure that the cone clamp cylinder 104 and jack cylinder 56 will remain in their lowered retracted positions during this mode of operation.

The heater preferably is selected and mounted in a position in which its focal point, as indicated at 133, in FIG. 3, will be disposed below the level of the insole so that the infrared radiation will be directed toward the shoe bottom in a strip having a width just slightly greater than the width defined by the middle portion of the strip which contains the curable resinous matrix.

During the heating of the strip, the fingers bear down resiliently but lightly on the margins 28 of the flexible shank strip to urge the shank strip into firm conformity with the contour of the shoe bottom. The downward biasing of the fingers 122 assures that the shank strip will be urged into full contact with the insole bottom, particularly as the heat is applied which, in the very early portion of the exposure cycle, will cause any portions of the shank strip which may not have fully contacted the insole bottom to become limp and fall into such contact with the insole.

The radiant heater is operated to expose the shank strip to the radiant heat which is transmitted through the upper surface of the sleeve to the resin matrix. The duration of the exposure will depend on the composition of the resinous matrix and the magnitude of exothermal heat which may be generated in the curing reaction. By way of example only, an exposure time of the order of between three to seven seconds may be appropriate. The shoe assembly may be permitted to remain in the machine for a short time after exposure to permit the material to cure, in situ.

During the activation and curing of the resin, the fingers 122 hold the margin 28 firmly in place. As described in the aforementioned pending applications, the upper surface of the shank strip is selected so that it will maintain its dimensional characteristics and will not deteriorate at least until the resin has cured to a substantially final shape and configuration. The fingers 122 serve to hold down the upper strip to resist expansion of the resin matrix which might occur from gases which may be generated during the reaction. Also as described in the aforementioned applications, the upper strip of the shank strip may, in some instances, be formed from a material which will shrink under the influence of heat. The fingers 58 develop sufficient downward force to hold the upper strip in position and preclude it from slipping as the heated portion of the top skin shrinks. This applies a slightly increased pressure to the resin to control and limit the height and cross-sectional shape of the shank when it is finally cured. The force with which the fingers urge the strip margins into engagement with the insole bottom may be requlated by an adjustment to the compression springs 156.

As described more fully in the aforementioned copending patent applications, the cured shank strip will remain firmly bonded to the insole bottom. This may result from melting of the insole-engaging lower surface of the sleeve in which the melted portion of the sleeve cross links with the resin and also adheres to the insole bottom. Depending on the materials from which the sleeve is made, there may be instances in which it is desirable to slit the bottom surface of the sleeve to provide direct communication between the resin and the insole bottom or in other instances, an adhesive agent may be applied to the insole engaging surface of the shank strip but to the insole bottom itself.

From the foregoing, it will be appreciated that the invention may be employed to automatically position and locate a shank strip of the type described in a manner which requires relatively little operator skill and which insures that the shank strip will be properly placed, applied and cured in situ on the shoe bottom. It should be understood, however, that the foregoing description of the invention is intended merely to be illustrative thereof and that other embodiments and modifiations may be apparent to those skilled in the art without departing from its spirit.

Having thus described the invention, what I desire to claim and secure by Letters Patent is:

1. An apparatus for applying a strip of activatable material to the bottom of an insole of a shoe assembly to form a shank in situ on the bottom of the insole, said strip including an activatable matrix surrounded by a sleeve, said apparatus comprising:

a frame;

shoe support means mounted to the frame for firmly supporting the shoe assembly;

strip retaining means on the frame and having strip engaging portions spaced from the shoe support means;

positioning means for locating a strip in a predetermined position between and in alignment with the strip retaining means and shoe support means;

said shoe support means being mounted for movement toward and away from the strip retaining means between a first, remote position and a second, operative position in which the insole may be urged against the strip engaging portions of the strip engaging means;

said shoe support and strip retaining means being constructed and arranged so that as the shoe support means moves from its first to its second position, the insole of a supported shoe assembly will engage the positioned strip and continued movement of the shoe support means will carry and urge the strip and insole bottom against the strip engaging portions of the strip retaining means to hold the strip against the insole; and means for activating the matrix while the strip is held against the insole bottom.

2. An apparatus as defined in claim 1 further comprising:

said strip retaining means being constructed and arranged to resiliently urge the strip, substantially along its length, into contact with the insole bottom during operation of the activating means.

3. An apparatus as defined in claim 1 further comprising:

said strip retaining means being constructed and arranged to engage the laterally disposed, longitudinally extneding marginal portions of the strip.

4. An apparatus as defined in claim 1 wherein said strip further includes a sleeve having laterally projecting, longitudinally extending margins, said apparatus further comprising:

said strip retaining means comprising means for engaging each of the margins of said sleeve and for urging said margins, resiliently, toward the insole bottom.

5. An apparatus as defined in claim 1 wherein the strip includes an elongate sleeve having laterally projecting, longitudinally extending marginal portions, the apparatus further comprising:

said strip engaging means including a pair of generally parallel resilient means for engaging the opposite side marginal portions of the strip;

said resilient means being constructed and arranged to conform to the contour of the bottom of the shoe insole when the shoe insole is urged toward and against the resilient means.

6. An apparatus as defined in claim 5 wherein each of said resilient means comprises a group of longitudinally spaced fingers having tips which comprise said strip engaging portions;

the upper end of each finger being received within a guide, said guides being constructed to receive the upper portions of the fingers and enable the fingers to move longitudinally within the guides; and bias means associated with each of the guides for resiliently urging the fingers in a direction which extends downwardly and outwardly of the guides.

7. An apparatus as defined in claim 6 wherein the fingers are relatively stiff in a laterial direction.

8. An apparatus as defined in claim 6 further comprising:

said finger guides being arranged in an attitude which will guide the fingers for movement in a laterally outward direction as the fingers are urged in an upward direction.

9. An apparatus as defined in claim 8 wherein the finger guides are mounted by means comprising:

a pair of longitudinally extending, spaced rods, each of the rods carrying a plurality of finger guides;

each finger guide including means for releasably clamping the guide to its associated rod thereby enabling the angular and longitudinal position of the guide to be adjusted on its associated rods.

10. An apparatus as defined in claim 1 further comprising:

said positioning means including means for releasably retaining said strip; and means for moving said positioning means between a remote position in which a strip may be loaded on the positioning means and an operative position in which the positioning means holds the strip in said predetermined position.

11. A apparatus as defined in claim 10 further comprising:

said positioning means being constructed and arranged to enable it to move freely and in unison with the shoe assembly and the strip as the shoe support moves toward its second position;

means for causing the positioning means to release the strip when the shoe support means reaches its second position; and means for thereafter moving the positioning means to its remote position.

12. An apparatus as defined in claim 11 further comprising:

said positioning means including a transfer head having suction pad means;

means for communicating the suction pad means with a vacuum source; and control means for disconnecting the vacuum source from the suction pads at least when the transfer head is moved to its remote position and for reconnecting the vacuum source while the transfer head is in the remote position.

13. An apparatus as defined in claim 11 wherein said means for moving the positioning means from its operative to its remote position comprises:

means for first moving the positioning means upwardly away from the shoe assembly and for thereafter swinging the positioning means laterally upwardly and away from the shoe assembly.

14. An apparatus as defined in claim 13 wherein the means mounting the transfer head for said movement comprises:

an arm;

means connecting the transfer head to one end of the arm;

a lever connected at one end to the other end of the arm, the lever being mounted for pivotal movement about a first longitudinally extending pivot, the first pivot being connected between the ends of the lever;

first drive means connected to the other end of the lever at a second pivot to effect pivoting of the lever about the first pivot;

second drive means connected to the first pivot to effect pivoting of the lever about the second pivot; and control means for initially operating both of said drive means in unison to linearly raise the lever without any pivotal movement of the lever, thereby raising the arm and transfer head, and then for operating said first drive means to swing the lever about the first pivot to swing the arm and transfer head laterally and upwardly toward their remote position.

15. An apparatus as defined in claim 14 further comprising:

control means for returning the transfer head to its first position comprising means for operating the first drive means to swing the lever, arm and transfer head about the second pivot, the arc defined by the transfer head during such movement being greater than the arc defined when the lever is pivoted about the first pivot, the magnitude of said larger arc being sufficient to insure that a strip carried by the transfer head will swing below the strip retaining means as the transfer head moves from its remote to its operative position.

16. An apparatus as defined in claim 15 further comprising:

manually actuable control means for independently operating the first drive means to swing the transfer head between its remote and operative positions.

17. An apparatus as defined in claim 13 further comprising:

means connecting the transfer head to the end of the arm for limited pivotal movement about a transversely extending axis; and means pivotally connecting the other end of the arm to the lever for limited pivotal movement.

18. An apparatus as defined in claim 1 wherein the shoe support means comprises:

a V-shaped heel locator receptive to the heel quarter portions of the shoe assembly;

a heel seat pin disposed above the heel locator for determining the upper position of the heel seat of the shoe assembly;

ball locator means disposed forwardly of the heel seat pin to determine the heightwise position of the ball portion of the shoe assembly; and a cone clamp supported on the frame at a location below and forwardly of the more heelward portions of the shoe support means, said cone clamp means being movable upwardly and rearwardly toward and away from the cone portion of the shoe assembly, said clamp being free of any other operating instrumentalities disposed about the heel portion of the shoe support means whereby the support may be used with equal facility with low cut shoes as well as boots.

19. An apparatus for applying a strip of activatable material to the bottom of an insole of a shoe assembly to form a shank in situ on the bottom of the insole, said strip including an activatable matrix surrounded by a sleeve, said apparatus comprising:

a frame;

shoe support means mounted to the frame for firmly supporting the shoe assembly;

strip retaining means supported by the frame and having strip engaging portions adapted to press a strip toward and against the insole bottom;

means mounting the shoe support means and the strip retaining means to the frame so that one may be moved relative to the other between a first, remote position and a second, operative position in which the strip retaining means may be urged against the insole of a shoe assembly supported in the shoe support means;

positioning means for locating a strip between the strip retaining means and a shoe assembly supported in the shoe support means when the shoe support means and strip retaining means are in their first position;

means for thereafter effecting relative movement between said shoe support means and the positioning means to move them toward their second position to cause the strip retaining means to urge the strip firmly against the insole bottom; and means for activating the strip while it is maintained against the insole bottom.

20. A shoe jack assembly comprising:

a frame;

a V-shaped heel locator mounted to the frame and being receptive to the heel quarter portions of the shoe assembly;

a heel seat pin disposed above the heel locator for determining the upper position of the heel seat of the shoe assembly;

ball locator means disposed forwardly of the heel seat pin to determine the heightwise position of the ball portion of the shoe assembly; and a cone clamp supported on the frame at a location below and forwardly of the cone region of a shoe assembly in engagement with the heel locator, heel seat pin and ball locator means, said cone clamp means being movable upwardly and rearwardly toward and away from the cone portion of the shoe assembly, said clamp being free of any other operating instrumentalities disposed about the heel portion of a supported shoe assembly whereby the support may be used with equal facility with low cut shoes as well as with boots.

21. A method for forming and applying a shank stiffener to the bottom of a shoe insole, said stiffener initially being in the form of an elongate flexible sleeve containing a flexible matrix of externally activatable thermosetting resin, said method comprising:

supporting a shoe assembly in a predetermined position, the shoe assembly having a last and an insole at its bottom;

aligning a strip engaging means with the insole bottom but in spaced relation thereto;

locating said stiffener between the strip engaging means and the insole of the supported shoe assembly, in alignment with but in spaced relation to the insole and strip retaining means;

thereafter effecting relative movement of the shoe assembly and the strip engaging means toward each other to cause the stiffener to be urged firmly toward the insole bottom by the strip engaging means; and activating the stiffener while it is maintained in engagement with the insole bottom.

22. A method as defined in claim 21 wherein said step of effecting relative movement of the shoe assembly and the strip retaining means towards each other comprises:

maintaining the strip retaining means in its initial position while moving the shoe assembly toward the strip engaging means until the insole engages the stiffener;

thereafter continuing movement of the shoe assembly and stiffener in unison toward the strip retaining means to bring the stiffener into engagement with the retaining means.

23. A method as defined in claim 22 further comprising:

continuing movement of the combined shoe assembly, stiffener and retaining means and permitting the retaining means to yieldably move therewith; and effecting laterally outward movement of the strip retaining means in response to continued advancement of the strip retaining means, thereby to apply a laterial tension to the sleeve.

24. An apparatus as defined in claim 10 further comprising:

said means for releasably retaining the strip comprising a transfer head;

the means for moving the positioning means being constructed and arranged to move the transfer head first in an upward direction and then, arcuately, in a lateral and upward direction to its remote position.

25. A method for forming and applying a shank stiffener to the bottom of a shoe insole, said stiffener initially being in the form of an elongate flexible sleeve containing a flexible matrix of externally activatable resin, said sleeve and matrix being flexible and deformable, as a unit, to enable it to substantially conform to the contour of the bottom of the shoe insole while in an unactivated condition, said method comprising:

supporting a shoe assembly in a predetermined position, the shoe assembly having a last and an insole at its bottom;

aligning a strip engaging means with the insole bottom but in spaced relation thereto;

locating said stiffener between the strip engaging means and the insole of the supported shoe assembly, in alignment with but in spaced relation to the insole and strip engaging means;

thereafter effecting relative movement of the shoe assembly and the strip engaging means toward each other to cause the stiffener to be urged firmly toward the insole bottom by the strip engaging means; and activating the stiffener while it is maintained in engagement with the insole.

* * * * *